US009463577B2

(12) United States Patent
Martin et al.

(10) Patent No.: US 9,463,577 B2
(45) Date of Patent: Oct. 11, 2016

(54) PAPER CUTTING MECHANISMS

(71) Applicants: Tim Martin, Portland, OR (US); Robert W. Martell, Portland, OR (US); Dan Meyer, Lake Oswego, OR (US)

(72) Inventors: Tim Martin, Portland, OR (US); Robert W. Martell, Portland, OR (US); Dan Meyer, Lake Oswego, OR (US)

( * ) Notice: Subject to any disclaimer, the term of this patent is extended or adjusted under 35 U.S.C. 154(b) by 72 days.

(21) Appl. No.: 14/242,750

(22) Filed: Apr. 1, 2014

(65) Prior Publication Data

US 2015/0273716 A1 Oct. 1, 2015

(51) Int. Cl.

*B26D 5/00* (2006.01)
*B26D 7/01* (2006.01)
*B26D 1/10* (2006.01)

(52) U.S. Cl.

CPC ..... *B26D 7/015* (2013.01); *B26D 1/105* (2013.01); *B26D 5/00* (2013.01); *Y10T 83/566* (2015.04)

(58) Field of Classification Search

CPC ..... B26D 7/015; B26D 1/105; B26D 5/00; Y10T 83/566
USPC ..... 83/374–395, 614
See application file for complete search history.

(56) References Cited

U.S. PATENT DOCUMENTS 1,732,148 A * 10/1929 Barrett ..... D06H 7/02 83/383
5,503,053 A * 4/1996 Onishi ..... B26D 1/245 83/488
5,613,415 A * 3/1997 Sanpei ..... B26D 1/205 271/268
5,881,623 A * 3/1999 Otani ..... B26D 1/245 83/455
8,316,746 B2 * 11/2012 Hediger ..... B26D 7/025 83/451
8,807,855 B2 * 8/2014 Suzuki ..... B26D 7/2628 400/611

* cited by examiner

*Primary Examiner* — Omar Flores Sanchez
(74) *Attorney, Agent, or Firm* — Mohr Intellectual Property Law Solutions, PC

(57) ABSTRACT

Paper cutting mechanisms for cutting paper in a printing device including a drive mechanism, a cutting device coupled to the drive mechanism, and a retention mechanism including a trigger and a retaining portion configured to mechanically interact with the cutting device to selectively deploy the retention mechanism to retain the paper. In some examples, paper cutting mechanism includes a trigger including an elbow, a first arm extending from the elbow, and a second arm extending from the elbow offset from the first arm, and a rotation shaft extending from the elbow transverse to a plane defined by the first arm and the second arm. In some further examples, the paper cutting mechanism includes a resilient member cooperatively coupled with a paper engaging end of the retaining portion.

19 Claims, 7 Drawing Sheets

PAPER CUTTING MECHANISMS

BACKGROUND

The present disclosure relates generally to paper cutting mechanisms. In particular, paper cutting mechanisms with mechanical paper retention mechanisms are described.

Known paper cutting mechanisms are not entirely satisfactory for the range of applications in which they are employed. For example, known paper cutting mechanisms fail to account for the weight of paper being cut. As paper is cut in existing paper cutting mechanisms, gravity drags the cut portion of the paper downward, thereby skewing the cut as the cutting mechanism travels across the paper. Thus, rather than cutting a clean, straight edge on the paper, existing paper cutting mechanisms skew cuts on wide, heavy paper.

Further, many existing paper cutting mechanisms are electronically actuated. Electronically actuated paper guides are more complicated and expensive than mechanical equivalents. Electronically actuated paper guides are likely to malfunction or cease working altogether. Existing electronically actuated paper cutting mechanisms require expensive maintenance or repair to return the paper cutting mechanism to working order.

In addition, conventional paper cutting mechanisms lack self-correcting features that allow the paper cutting mechanism to continue to cut paper after an error has occurred. When conventional paper cutting mechanisms undergo a component malfunction, the paper cutters must be taken off-line for maintenance and repair.

Thus, there exists a need for paper cutting mechanisms that improve upon and advance the design of known paper cutting mechanisms. In particular, there exists a need for paper cutting mechanisms that cut clean, straight edges on a wide variety of paper with different weights and thicknesses. Further, there exists a need for mechanical paper cutting mechanisms that are cost effective and reliable. Moreover, there exists a need for robust paper cutting mechanisms that can handle errors and process irregularities. Examples of new and useful paper cutting mechanisms relevant to the needs existing in the field are discussed below.

SUMMARY

The present disclosure is directed to paper cutting mechanisms for cutting paper in a printing device including a drive mechanism, a cutting device coupled to the drive mechanism, and a retention mechanism including a trigger and a retaining portion configured to mechanically interact with the cutting device to selectively deploy the retention mechanism to retain the paper. In some examples, paper cutting mechanism includes a trigger including an elbow, a first arm extending from the elbow, a second arm extending from the elbow offset from the first arm, and a rotation shaft extending from the elbow transverse to a plane defined by the first arm and the second arm. In some further examples, the paper cutting mechanism includes a resilient member cooperatively coupled with a paper engaging end of the retaining portion.

DETAILED DESCRIPTION

Figure 1:
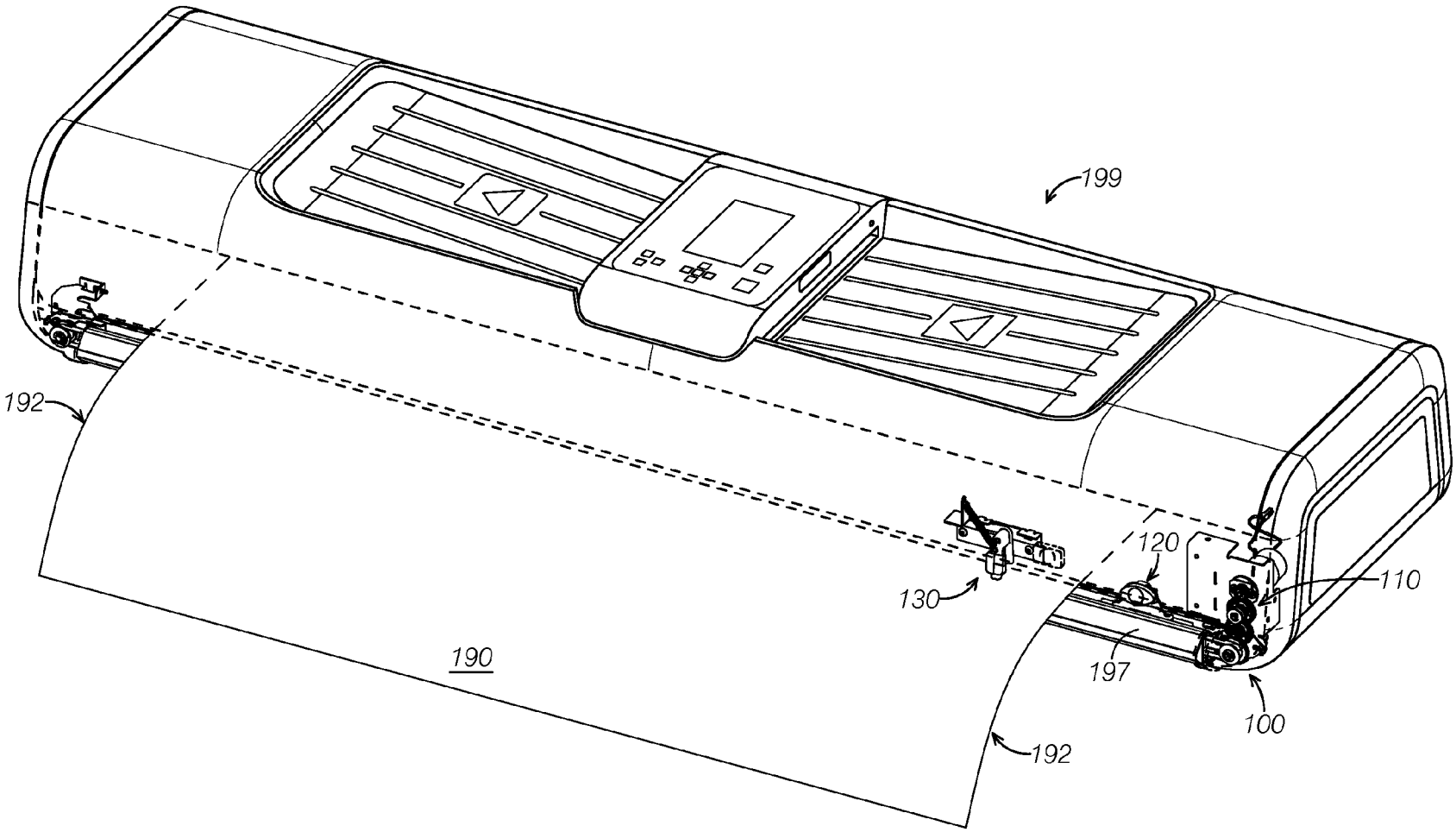
FIG. 1 is a front perspective view of a first example of a paper cutting mechanism depicting the paper cutting mechanism inside a thermal printing device.

The disclosed paper cutting mechanisms will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various paper cutting mechanisms are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-8, a first example of a paper cutting mechanism, paper cutting mechanism 100, will now be described. Paper cutting mechanism 100 includes a drive mechanism 110, a cutting device 120 coupled to drive mechanism 110, and a retention mechanism 130. Paper cutting mechanism 100 functions to cut paper 190 in a printing device 199.

Specifically, paper cutting mechanism 100 functions to cut 36-inch wide poster paper in thermal printing devices. Additionally or alternatively, paper cutting mechanisms can be used to cut variable-width substrate material in printing devices. Examples of substrate materials suitable for cutting in paper cutting mechanisms include, but are not limited to, paper, polyester, and vinyl.

Paper cutting mechanism 100 addresses limitations of existing cutting mechanisms by incorporating retention mechanism 130. As discussed in detail below, retention mechanism 130 is selectively deployed to retain paper 190 in printing device 199. By retaining paper 190 in place after paper 190 has been cut, retention mechanism 130 facilitates or allows paper cutting mechanism 100 to make clean, straight cuts.

As can be seen in the figures, paper cutting mechanism 100 is a mechanical device. Those skilled in the art of paper cutting mechanisms will appreciate that paper cutting mechanism 100 is comparatively less complicated, less expensive, and more reliable than electronically actuated systems providing comparable functions. Explained more fully below, paper cutting mechanism 100 is configured to handle process irregularities without interrupting or stopping the process to address the issue.

Figure 3:
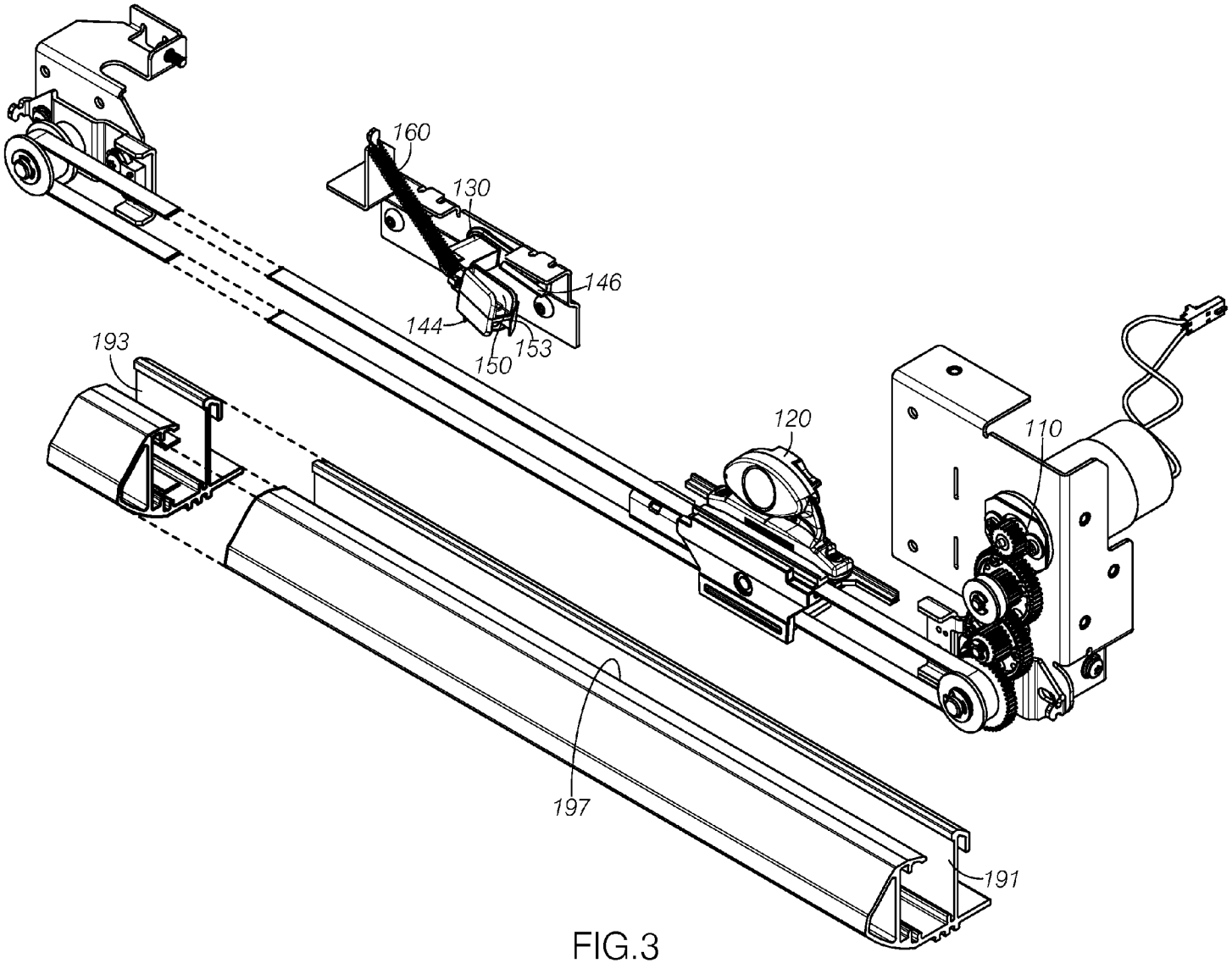
FIG. 3 is a front perspective view of the paper cutting mechanism shown in FIG. 1 depicting the paper cutting mechanism removed from a channel of the thermal printing device.
Figure 4:
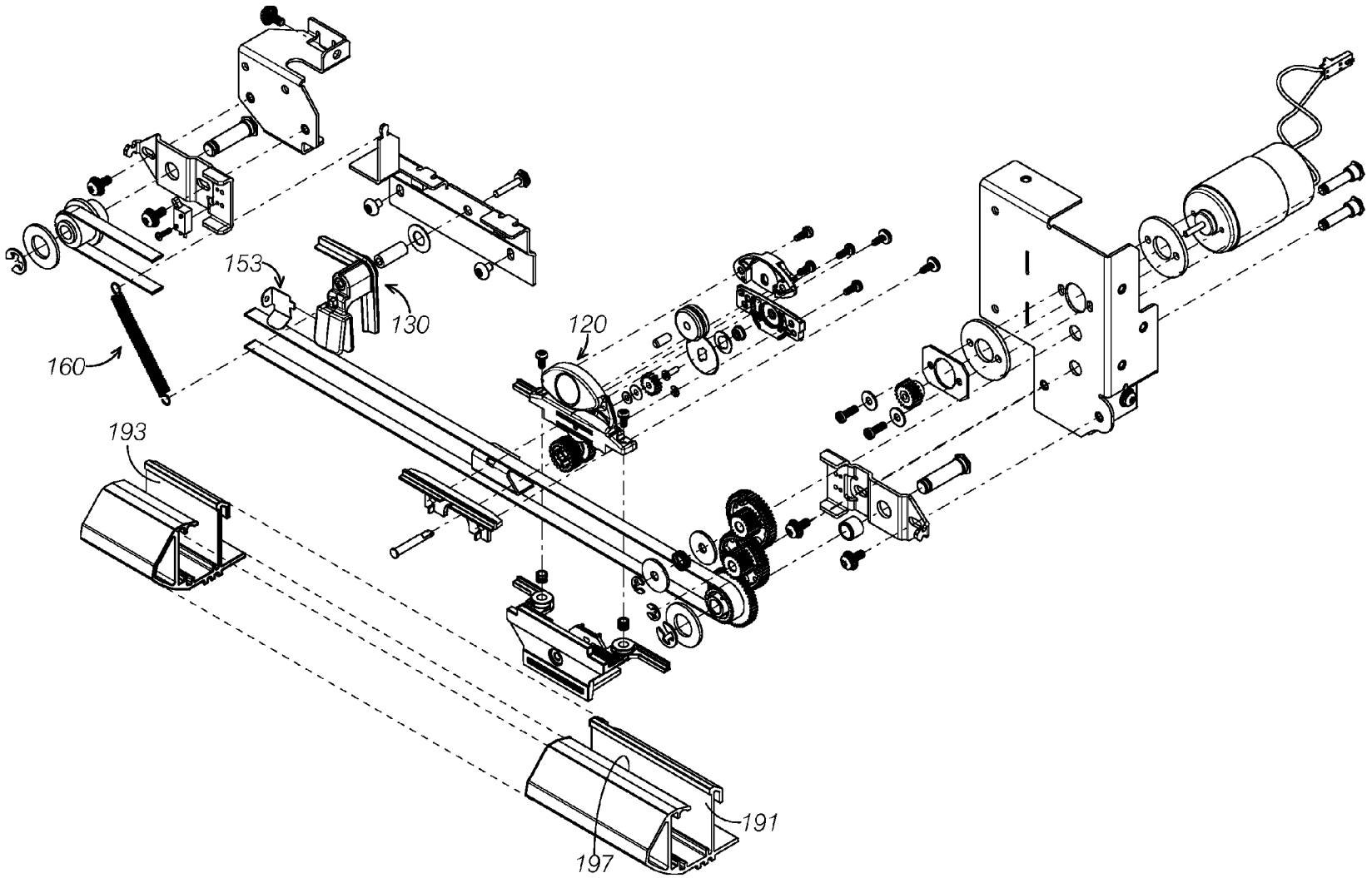
FIG. 4 is an exploded view of the paper cutting mechanism shown in FIG. 1.

As shown most clearly in FIG. 3, drive mechanism 110 is operatively coupled to cutting device 120 to propel cutting device 120 within printing device 199. In the FIG. 3 example, drive mechanism 110 includes a corrugated belt coupled to printing device 199 and a motor driving the belt. Alternatively, the drive mechanism may be any now known or later developed mechanism suitable for moving the cutting device within the printing device. Acceptable drive mechanisms include, but are not limited to, pulleys, wheels, screws, levers, and carriages.

Figure 2:
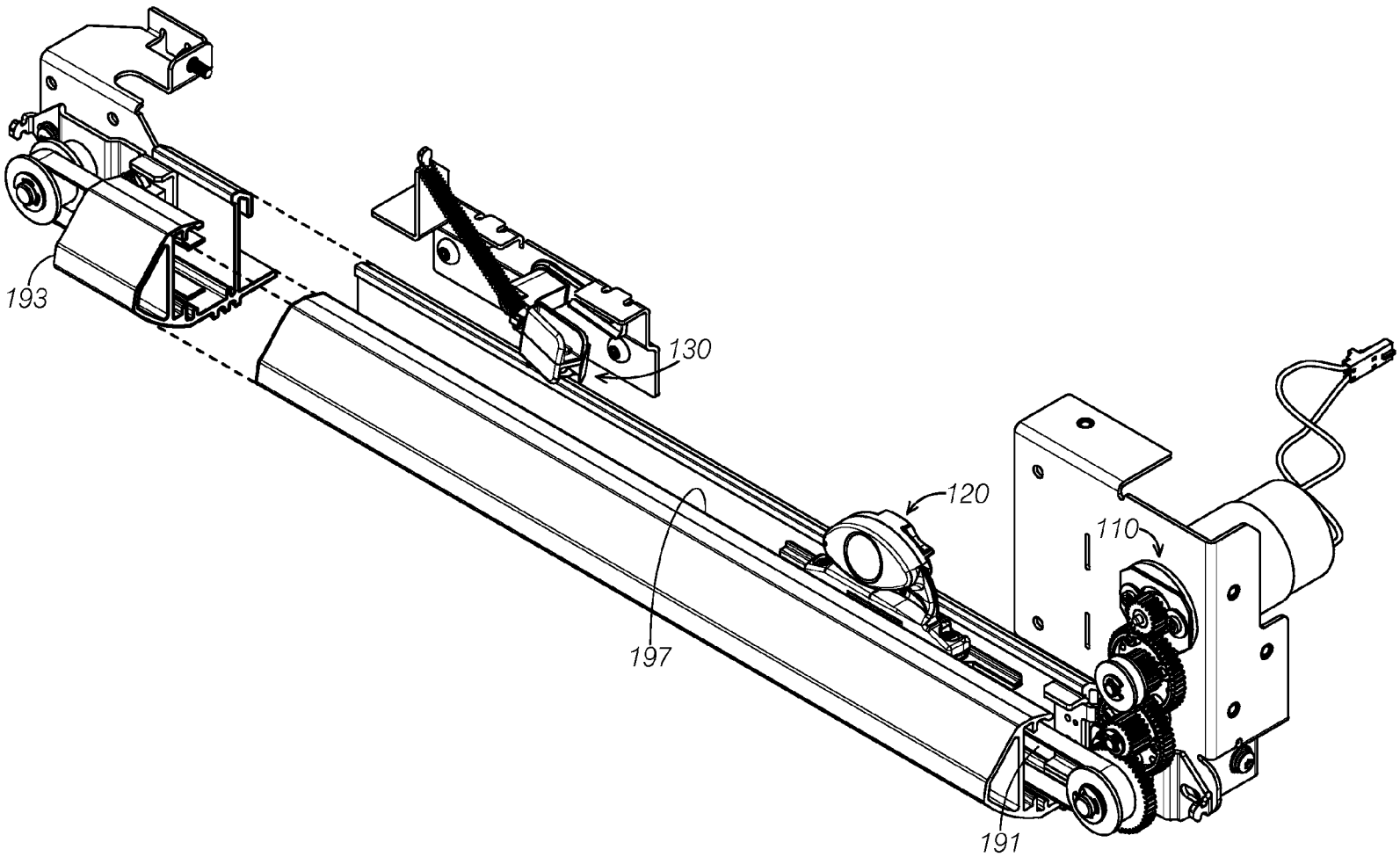
FIG. 2 is a front perspective view of the paper cutting mechanism shown in FIG. 1 depicting the paper cutting mechanism outside of the thermal printing device.

As shown in FIGS. 1 and 2, drive mechanism 110 propels cutting device 120 within channel 197. Drive mechanism 110 propels cutting device 120 from a first channel end 191 to a second channel end 193. Additionally, drive mechanism 110 propels cutting device 120 from second channel end 193 to first channel end 191.

In the example shown in FIG. 3, cutting device 120 is configured as a pinch-cutter with a circular cutting blade. Alternatively, the cutting device may be configured as any now known or later invented cutting device. Examples of alternative cutting devices include, but are not limited to linear and non-linear razor blades, and roll cutters.

As shown in FIG. 3, cutting device 120 is complimentarily configured with retention mechanism 130. Cutting device 120 mechanically interacts with retention mechanism 130 to rotate retention mechanism 130 when cutting device 120 moves between first channel end 191 and second channel end 193.

Figure 5:
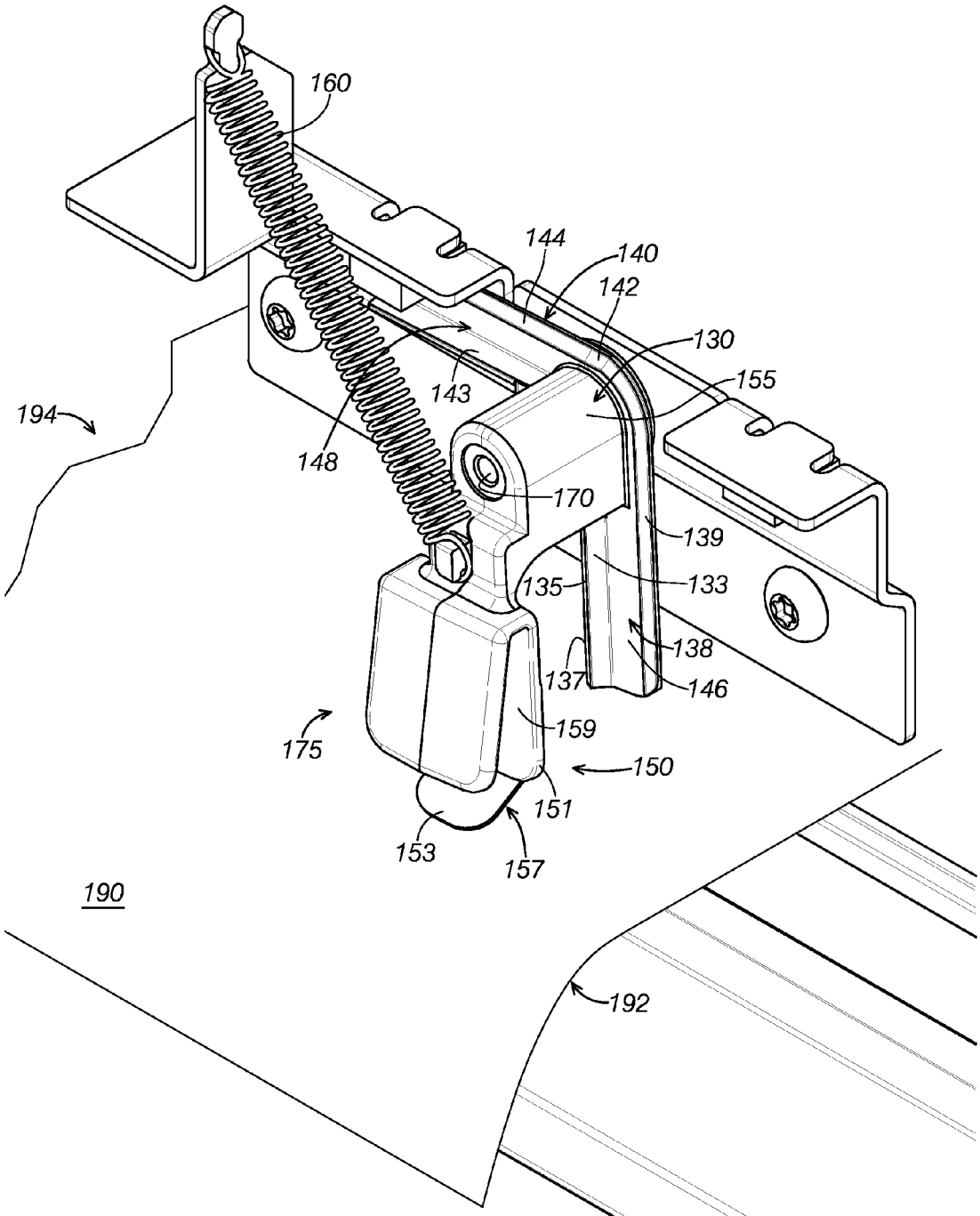
FIG. 5 is a front perspective view of the paper cutting mechanism shown in FIG. 1 depicting a retention mechanism of the paper cutting mechanism.
Figure 6:
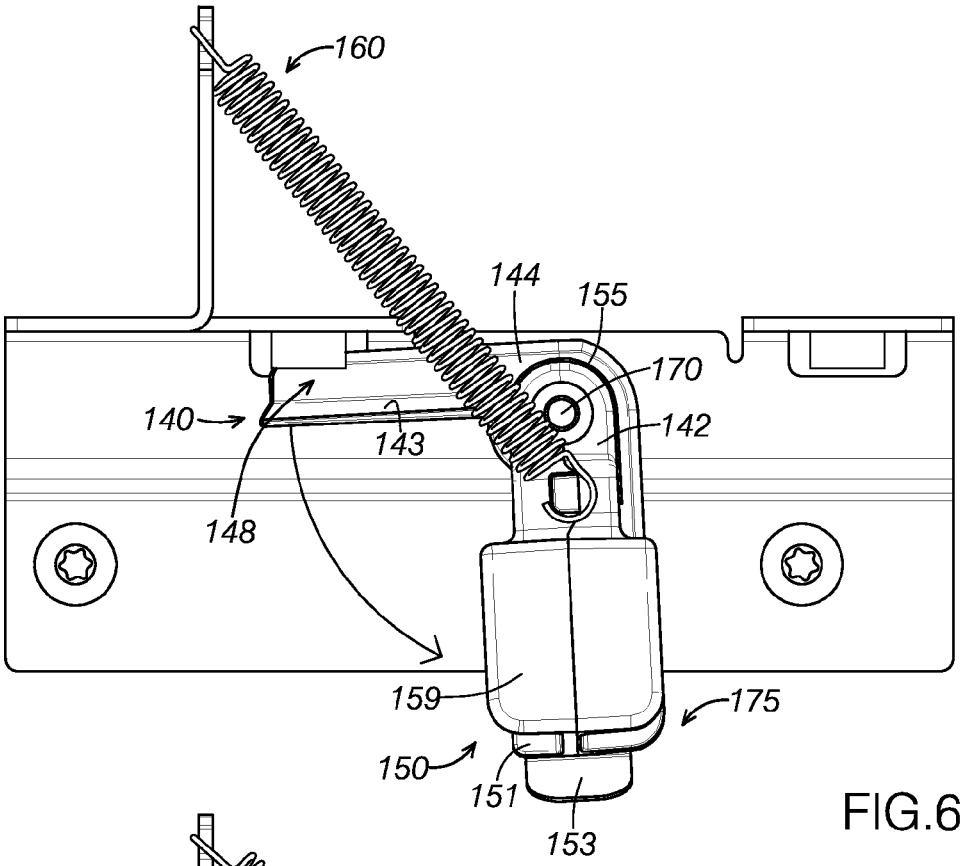
FIG. 6 is a front elevation view of the paper cutting mechanism shown in FIG. 1 depicting the retention mechanism in a paper-engaging position.
Figure 7:
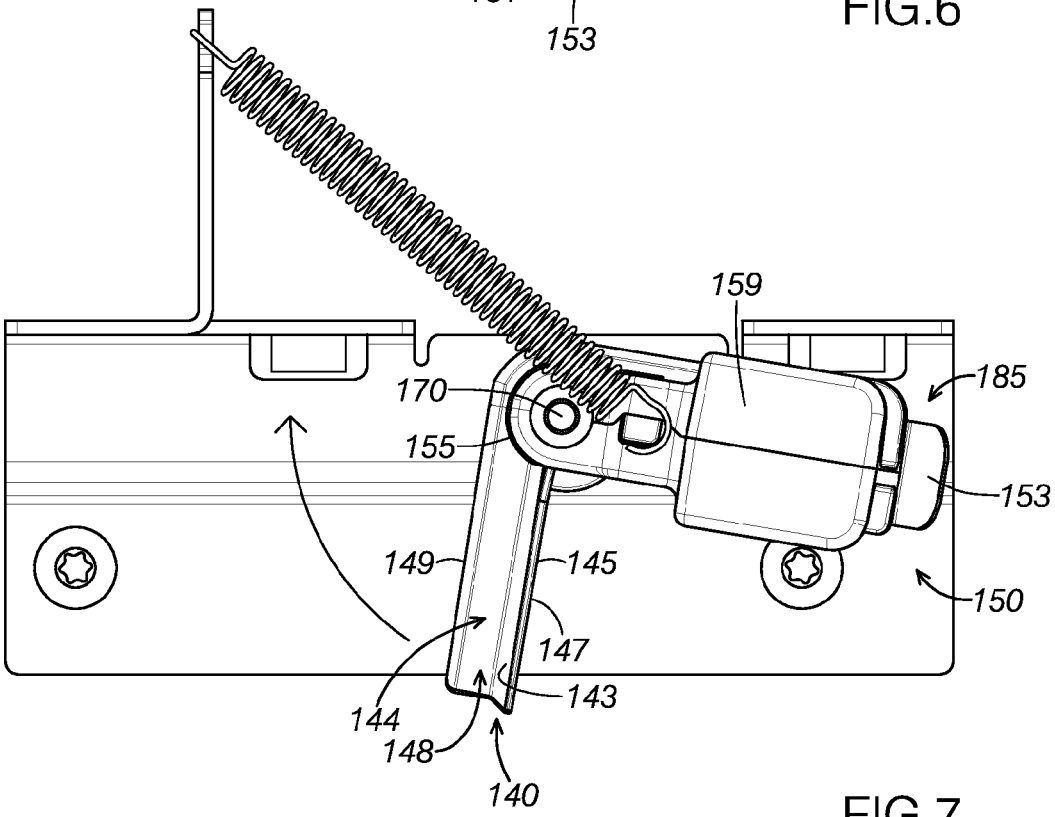
FIG. 7 is a front elevation view of the paper cutting mechanism shown in FIG. 1 depicting the retention mechanism in a non-paper-engaging position.

As shown in FIGS. 5-7, retention mechanism 130 is configured to rotate when mechanically interacting with cutting device 120 to selectively deploy retention mechanism 130 to retain paper 190. Retention mechanism 130 includes a trigger 140, a rotation shaft 170 and a retaining portion 150.

Mechanically interacting with cutting device 120 is preferred over existing electronically-engaged cutting mechanisms, because troubleshooting failures in existing cutting mechanisms with electronic controls can be difficult, expensive, and time consuming. Thus, by mechanically interacting with trigger 140, cutting device 120 allows paper cutting mechanism 100 to avoid the maintenance pitfalls of conventional paper cutting mechanisms.

As shown most clearly in FIG. 5, trigger 140 includes an elbow 142, a first arm 144 extending from elbow 142, and a second arm 146 extending from elbow 142 offset from first arm 144. First arm 144 and second arm 146 are configured to mechanically interact with cutting device 120.

In the FIG. 5 example, trigger 140 is L-shaped; first arm 144 and second arm 146 are offset approximately 90-degrees. Alternatively, the trigger may be configured in any form that facilitates or allows the cutting device to selectively deploy and retract the retention mechanism when the cutting device moves between the first lateral side and second lateral side of the paper. Examples of acceptable triggers include, but are not limited to, levers, clutches, and mechanical switches.

In the example shown in FIG. 5, trigger 140 is comprised of plastic. Additionally or alternatively, the trigger may be comprised of any now known or later developed material. Acceptable trigger materials include, but are not limited to, wood, metal, rubber, ceramic, carbon fiber, and composites.

As shown in FIG. 1, cutting device 120 mechanically interacts with first arm 144 to selectively deploy retention mechanism 130 to an engaged position 175 when cutting device 120 travels from a first lateral side 192 to a second lateral side 194 of paper 190. In this case, mechanically interacting includes cutting device 120 physically contacting first arm 144 to rotate retention mechanism 130. Specifically, cutting device 120 pushes first arm 144 to rotate retention mechanism 130 to paper-engaging position 175. Mechanically interacting can also include other modes of physical contact between the cutting device and the first arm. The cutting device may rotate the retention mechanism by pulling, hooking, or flipping the first arm.

As shown in FIGS. 6-8B, first arm 144 includes a primary lateral side 145, a secondary lateral side 149, and a medial region 148. Primary lateral side 145 is proximate second arm 146 and spaced from secondary lateral side 149, which is distal second arm 146. Primary lateral side 145 includes a cutting-device-engaging surface 147.

Medial region 148 is disposed between primary lateral side 145 and a secondary lateral side 149. Medial region 148 is configured to allow cutting device 120 to travel past first arm 144 without rotating retention mechanism 130. As shown in FIGS. 5, 6, 7, and 8A, medial region 148 includes a inclined surface 143 proximate primary lateral side 145. In some examples, the medial region is inclined continuously or substantially continuously between the primary lateral side and the secondary lateral side.

With reference to FIGS. 6 and 7, cutting device 120 and retention mechanism 130 mechanically cooperate to rotate retention mechanism 130 to different positions. For example, cutting device 120 and retention mechanism 130 mechanically cooperate to rotate retention mechanism 130 to paper-engaging position 175, shown in FIG. 6, when cutting device 120 contacts cutting-device-engaging surface 147 of first arm 144 when travelling from first lateral side 192 to second lateral side 194 of paper 190. Further, cutting device 120 and medial region 148 of first arm 144 cooperate to maintain retention mechanism 130 in non-paper-engaging position 185, shown in FIG. 7, when cutting device 120 travels from second lateral side 194 to first lateral side 192 of paper 190.

In the example shown in FIG. 7, first arm 144 is solid, and medial region 148 guides or allows cutting device 120 to travel past first arm 144 when retention mechanism 130 fails to orient properly. In other words, when retention mechanism 130 is improperly in a non-paper-engaging position 185, cutting device 120 may travel past first arm 144 without rotating retention mechanism 130 when cutting device 120 travels from second lateral side 194 to first lateral side 192 of paper 190. Alternatively, the first arm may be spring-loaded to allow the cutting device to travel past the first arm when the retention mechanism is improperly in the non-paper-engaging position and the cutting device travels from the second lateral side to the first lateral side of the paper.

With reference to FIGS. 2, and 5-7, cutting device 120 mechanically interacts with second arm 146 to selectively retract retention mechanism 130 to a disengaged position 185 when cutting device 120 travels from second lateral side 194 to first lateral side 192 of paper 190. Alternatively, as discussed above the cutting device may also rotate the retention mechanism to the disengaged position by pulling, hooking, or flipping the second arm.

In the example shown in FIG. 5, second arm 146 is offset from first arm 144 at approximately 90-degrees. Alternatively, the second arm may be offset from the first arm at any angle that facilitates or allows the trigger to selectively deploy or retract the retention mechanism. Suitable offset angles include 30-degrees, 45-degrees, 120-degrees, and 180-degrees.

Figure 8A:
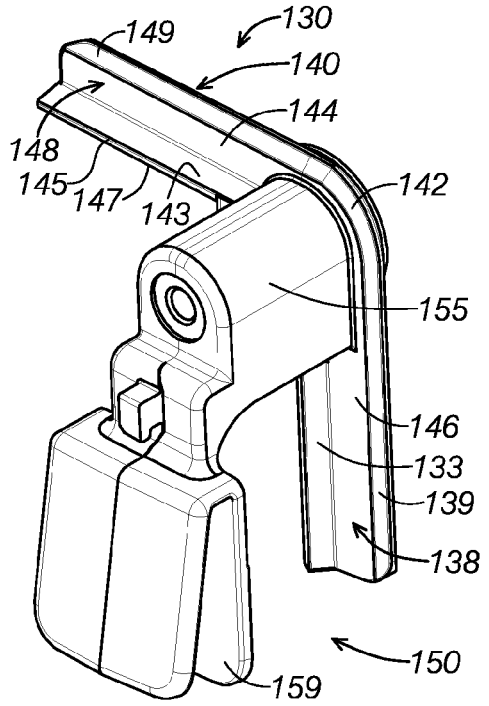
FIG. 8A is a perspective view of the retention mechanism.
Figure 8B:
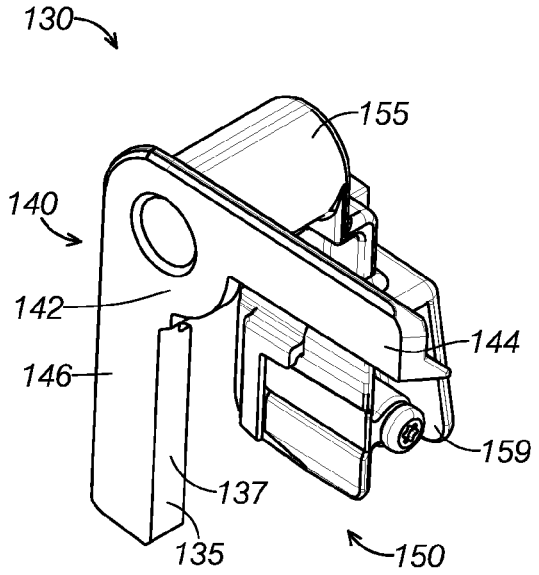
FIG. 8B is a perspective view of the retention mechanism.

With reference to FIGS. 5, 8A, and 8B, second arm 146 includes a primary lateral side 135, a secondary lateral side 139, and a medial region 138. Primary lateral side 135 is proximate first arm 144 and spaced from secondary lateral side 139, which is disposed distal first arm 144. As shown in FIG. 8B, primary lateral side 135 includes a cutting-device-engaging surface 137.

As shown in FIGS. 5 and 8A, medial region 138 extends between primary lateral side 135 and secondary lateral side 139. Medial region 138 is configured to allow cutting device 120 to travel past second arm 146 without rotating retention mechanism 130. As shown in FIGS. 5 and 8A, medial region 138 includes an inclined surface 133 proximate primary lateral side 135 to facilitate cutting device 120 moving past second arm without rotating retention mechanism 130. Inclined surface 133 helps cutting device 120 slide past second arm 146. In some examples, the entire medial region is inclined between the secondary lateral side and the primary lateral side.

In the example shown in FIG. 5, second arm 146 is solid, and medial region 138 is configured to guide cutting device 120 to travel past second arm 146 when retention mechanism 130 fails to orient properly. In other words, when retention mechanism 130 is improperly in a paper-engaging position 175, cutting device 120 may travel past second arm 146 without rotating retention mechanism 130 when cutting device 120 travels from first lateral side 192 to second lateral side 194 of paper 190. Alternatively, the second arm may be spring-loaded to allow the cutting device to travel past the second arm when the retention mechanism is improperly in the paper-engaging position.

As shown in FIGS. 2, 5, 6 and 7, cutting device 120 and retention mechanism 130 cooperate to rotate retention mechanism 130 to non-paper-engaging position 185 when cutting device 120 contacts cutting-device-engaging surface 137 of second arm 146 when travelling from second lateral side 194 to first lateral side 192 of paper 190. Additionally, cutting device 120 and medial region 138 of second arm 146 cooperate to maintain retention mechanism 130 in paper-engaging position 175 when cutting device 120 travels from first lateral side 192 to second lateral side 194 of paper 190.

Thus, as an additional advancement over existing paper cutting mechanisms, paper cutting mechanism 100 possesses self-correcting features that allow paper cutting mechanism 100 to continue to cut paper after a component position error has occurred. When paper cutting mechanism 100 malfunctions and retention mechanism 130 remains in the incorrect position, paper cutting mechanism 100 self-corrects. Paper cutting mechanism 100 eliminates the maintenance and repair necessary for conventional paper cutting mechanisms to function properly.

In the example shown in FIG. 5, rotation shaft 170 is cylindrical. Alternatively, the rotation shaft may be configured in any shape or form that facilitates or allows the rotation shaft to rotate and adequately space the first arm and the second arm from the retaining portion. The rotation shaft may be multiple pillars, pyramidal, or block-shaped. Alternatively, the rotation shaft may be linear or curved.

As shown in FIG. 5, retaining portion 150 includes a cantilever portion 155 and a retaining member 159. Retaining portion 150 is configured to selectively retain paper 190 to improve the paper cutting process. Retaining portion 150 selectively retains paper 190 when cutting device 120 travels between first lateral side 192 and second lateral side 194 of paper 190. In particular, retaining portion 150 selectively retains paper 190 when cutting device 120 mechanically interacts with trigger 140.

In the example shown in FIG. 5, retaining portion 150 is a solid, unitary member. Alternatively, the retaining portion may be a composite member, spring-loaded, levered, pliable, or configured in any shape or form that allows the retaining portion to retain paper. In the example shown in FIG. 5, retaining portion 150 is comprised of plastic. Additionally or alternatively, the retaining portion may be comprised of any now known or later developed material, including, but not limited to, wood, metal, rubber, ceramic, carbon fiber, and composites.

Cantilever portion 155 is supported by rotation shaft 170 and extends from trigger 140. As shown in FIG. 5, cantilever portion 155 extends from near elbow 142 transverse to a plane defined by first arm 144 and second arm 146. Cantilever portion 155 spaces retaining member 159 from first arm 144 and second arm 146 to give cutting device 120 room to mechanically interact with first arm 144 and second arm 146 without contacting retaining member 159.

As shown in FIGS. 5-8, retaining member 159 extends from cantilever portion 155 and includes a paper engaging end 151 configured to accommodate paper with different thicknesses. In the FIG. 5 example, paper engaging end 151 includes rounded corners to accommodate paper 190 and to facilitate retention mechanism 130 rotating readily within printing device 199. The paper engaging end may be configured in any manner that facilitates or allows accommodating paper with different thicknesses without restricting the retention mechanism from rotating. For example, the paper engaging end may be flat, tapered, curved, or rounded.

The paper-engaging end may include paper-engaging features to facilitate retaining paper. For example, the paper engaging end may include a layer of rubber, silicon, or plastic. In some examples, a rubber, silicon, or plastic body is coupled to the end of the paper engaging end.

As shown in FIGS. 5 and 6, retaining member 159 includes a resilient member 153 coupled to paper engaging end 151. Resilient member 159 is removably attached to retaining member 159, but the resilient member may be fixedly attached to the retaining member in some examples.

As shown in FIG. 5, resilient member 153 compresses or flexes when contacting the paper to accommodate paper with different thicknesses and to maintain solid contact with the paper. Additionally or alternatively, the resilient member may accommodate paper with different thicknesses through any now know or later developed method, including, but not limited to, flexing, bending, squishing, and springing. Resilient member 153 is biased towards the paper disposed beneath retaining member 159 to facilitate securing the paper and to accommodate paper with different thicknesses.

In the example depicted in FIG. 5, resilient member 153 is comprised of Mylar®. Additionally or alternatively, the resilient member may be comprised of any now known or later developed material, including, but not limited to, wood, metal, plastic, rubber, carbon fiber, and composites.

As shown in FIGS. 5-7, retention mechanism 130 further includes a biasing mechanism 160. Biasing mechanism 160 is configured to selectively maintain retention mechanism 130 in engaged position 175 and disengaged position 185.

As shown in FIG. 5, biasing mechanism 160 is a spring. Alternative examples of acceptable biasing mechanisms include, but are not limited to levers, cables, and pulleys.

Also shown in FIG. 5, biasing mechanism 160 is secured to retention mechanism 130 substantially near elbow 142. Biasing mechanism 160 is attached substantially near a fulcrum or pivot of retention mechanism 130. Alternatively, the biasing mechanism may be secured to the retention mechanism in any position that facilitates or allows selectively maintaining the retention mechanism in an engaged position and a disengaged position.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicants reserve the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. A paper cutting mechanism for cutting paper in a printing device, comprising:

a drive mechanism;

a cutting device coupled to the drive mechanism; and a retention mechanism configured to selectively deploy the retention mechanism to retain the paper, the retention mechanism including:

a biasing mechanism, the biasing mechanism configured to selectively retain the retention mechanism in an engaged position and a disengaged position;

a trigger; and a retaining portion operatively connected to the trigger and configured to selectively retain the paper when the cutting device mechanically interacts with the trigger.

2. The paper cutting mechanism of claim 1, wherein the trigger includes:

an elbow;

a first arm extending from the elbow; and a second arm extending from the elbow offset from the first arm.

3. The paper cutting mechanism of claim 2, wherein the paper includes:

a first lateral side; and a second lateral side spaced from the first lateral side;

wherein the cutting device is configured to travel between the first lateral side of the paper and the second lateral side of the paper to cut the paper.

4. The paper cutting mechanism of claim 3, wherein the cutting device is configured to interact with the first arm of the trigger to selectively deploy the retention mechanism to an engaged position when the cutting device travels from the first lateral side of the paper to the second lateral side of the paper.

5. The paper cutting mechanism of claim 4, wherein the cutting device is configured to interact with the second arm of the trigger to selectively retract the retention mechanism to a disengaged position when the cutting device travels from the second lateral side of the paper to the first lateral side of the paper.

6. The paper cutting mechanism of claim 2, wherein the biasing mechanism is a spring secured to the retention mechanism substantially near the elbow.

7. The paper cutting mechanism of claim 1, wherein the printing device is an industrial thermal printing device.

8. A paper cutting mechanism for cutting paper in a printing device, the paper having a first lateral side and a second lateral side spaced from the first lateral side, comprising:

a cutting device movingly coupled to the printing device; and a retention mechanism configured to selectively deploy the retention mechanism to retain the paper, the retention mechanism including:

a trigger including an elbow, a first arm extending from the elbow, and a second arm extending from the elbow offset from the first arm;

a rotation shaft extending from the elbow transverse to a plane defined by the first arm and the second arm; and a retaining portion connected to the rotation shaft and configured to selectively retain the paper when the cutting device mechanically interacts with the trigger.

9. The paper cutting mechanism of claim 8, wherein the cutting device and the retention mechanism cooperate to:

rotate the retention mechanism to a paper-engaging position when the cutting device contacts the first arm of the trigger when travelling from the first lateral side of the paper to the second lateral side of the paper, and maintain the retention mechanism in a non-paper-engaging position when the cutting device travels from the second lateral side of the paper to the first lateral side of the paper.

10. The paper cutting mechanism of claim 9, wherein the second arm of the trigger includes:

a primary lateral side proximate the second arm of the trigger and including a cutting-device-engaging surface;

a secondary lateral side spaced from the primary lateral side and distal the second arm of the trigger; and a medial region disposed between the primary lateral side and the secondary lateral side, the medial region being configured to allow the cutting device to travel past the first arm of the trigger without rotating the retention member.

11. The paper cutting mechanism of claim 10, wherein the medial region includes a inclined surface proximate the secondary lateral side and configured to guide the cutting device past the first arm without rotating the retention member.

12. The paper cutting mechanism of claim 11, wherein the second arm of the trigger includes:

a primary lateral side proximate the second arm of the trigger and including a cutting-device-engaging surface; and a secondary lateral side spaced from the primary lateral side and distal the second arm of the trigger;

a medial region disposed between the primary lateral side and the secondary lateral side, the medial region including a inclined surface configured to allow the cutting device to travel past the first arm of the trigger without rotating the retention member.

13. A paper cutting mechanism for cutting paper in a printing device including a channel including a first end and a second end, comprising:

a belt-drive mechanism;

a cutting device coupled to the belt-drive mechanism; and a retention mechanism configured to rotate to selectively deploy the retention mechanism to retain the paper, the retention mechanism including:

a trigger including a pivot, a first arm extending from the pivot, and a second arm extending from the pivot offset from the first arm;

a rotation shaft extending from the pivot transverse to a plane defined by the first arm and the second arm; and a retaining portion connected to the rotation shaft and configured to selectively retain the paper when the cutting device mechanically interacts with the trigger.

14. The paper cutting mechanism of claim 13, wherein the cutting device includes:

a body;

a cutting element integrated with the body; and a guide proximate the cutting element;

wherein the cutting element and the guide cooperate to cut the paper.

15. The paper cutting mechanism of claim 14, wherein:

the cutting device is complimentarily configured with the channel of the printing device; and the belt-drive mechanism moves the cutting device within the channel between the first end of the channel and the second end of the channel.

16. The paper cutting mechanism of claim 13, wherein a paper-engaging end of the retaining portion is configured to accommodate paper having different thicknesses.

17. The paper cutting mechanism of claim 16, wherein the paper-engaging end of the retaining portion further includes a resilient member coupled to the paper-engaging end.

18. The paper cutting mechanism of claim 17, wherein the resilient member is biased in a paper engaging position and is removably attached to the retaining portion.

19. The paper cutting mechanism of claim 13, wherein the trigger extends in a L-shape configuration.

* * * * *